US007867014B2

(12) United States Patent
Kuwayama

(10) Patent No.: US 7,867,014 B2
(45) Date of Patent: Jan. 11, 2011

(54) PRESS-CLAMPING TERMINAL FOR ALUMINUM WIRE

(75) Inventor: Yasumichi Kuwayama, Makinohara (JP)

(73) Assignee: Yazaki Corporation, Tokyo (JP)

( * ) Notice: Subject to any disclaimer, the term of this patent is extended or adjusted under 35 U.S.C. 154(b) by 91 days.

(21) Appl. No.: 12/256,508

(22) Filed: Oct. 23, 2008

(65) Prior Publication Data

US 2009/0130923 A1 May 21, 2009

(30) Foreign Application Priority Data

Nov. 16, 2007 (JP) ..... 2007-298441

(51) Int. Cl.
*H01R 13/11* (2006.01)

(52) U.S. Cl. ..... 439/452

(58) Field of Classification Search ..... 439/442, 439/424, 882, 421, 852; 174/84 C
See application file for complete search history.

(56) References Cited

U.S. PATENT DOCUMENTS 2,685,076 A * 7/1954 Hoffman ..... 439/882
2,854,648 A * 9/1958 Berg ..... 439/867
3,812,448 A * 5/1974 Haitmanek ..... 439/421
3,892,459 A * 7/1975 Dittmann et al. ..... 439/442
4,142,771 A * 3/1979 Barnes et al. ..... 439/442
6,290,556 B1 * 9/2001 Howland et al. ..... 439/879

FOREIGN PATENT DOCUMENTS

JP 2007-173215 A 7/2007

* cited by examiner

*Primary Examiner*—Alexander Gilman
(74) *Attorney, Agent, or Firm*—Sughrue Mion, PLLC

(57) ABSTRACT

An aluminum wire press-clamping terminal is press-clamped to an aluminum wire having a conductor portion in which a plurality of aluminum- or aluminum alloy-made strands are twisted. The aluminum wire press-clamping terminal includes: a bottom plate portion for placing the conductor portion thereon; a pair of caulking piece portions which are extended from the bottom plate portion and adapted to be caulked to the conductor portion on the bottom plate portion to hold the conductor portion therebetween; and at least one groove and at least one convex portion which are formed on contact surfaces of the bottom plate portion and the pair of caulking piece portions, the contact surfaces being adapted to contact the conductor portion. The convex portion extends in a direction perpendicular to an axial direction of the conductor portion.

7 Claims, 4 Drawing Sheets

PRESS-CLAMPING TERMINAL FOR ALUMINUM WIRE

BACKGROUND OF THE INVENTION

1. Technical Field

This invention relates to an aluminum wire press-clamping terminal (or crimp-type terminal) for being press-clamped (or crimped to) an aluminum wire having a conductor portion in which a plurality of aluminum- or aluminum alloy-made strands are twisted.

2. Background Art

Generally, copper wires are used in a wire harness installed in a vehicle such as an automobile. For connecting such wire harnesses together or for connecting such a wire harness to on-board equipments, terminals are fixedly secured to the copper wires, and the terminal of this kind is fixedly secured to the copper wire usually by press-clamping (that is, crimping).

The terminal for being press-clamped to the copper wire is formed by blanking a piece of a predetermined shape from an electrically-conductive sheet (made, for example, of a copper alloy) into a predetermined shape and then by bending the blanked-out piece into a final shape. Typically, such a terminal includes a bottom plate portion for placing a conductor portion (composed of a plurality of copper strands twisted together) of the copper wire thereon, and a pair of caulking piece portions extending from the bottom plate portion so as to hold the conductor portion (placed on the bottom plate portion) therebetween. When the caulking piece portions are caulked to the conductor portion, each caulking piece portion embraces part of the strands of the conductor portion, with its distal end portion piercing into the conductor portion. Thus, the terminal is press-clamped to the conductor portion of the copper wire.

In recent years, in view of the shortage of copper resources, a lightweight design of a vehicle and recyclability, attention has been directed to aluminum wires. However, an oxide film formed on a surface of an aluminum product is thicker than that on a copper product, and in the case of an aluminum wire, a contact resistance between a conductor portion and a terminal tends to become relatively high. One known method of reducing this contact resistance is to caulk the caulking piece portions of the terminal hard to the conductor portion, thus increasing the compressibility of the conductor portion. In this method, oxide films formed on the strands of the conductor portion are destroyed, so that the contact resistance between the conductor portion and the terminal is reduced. In the present specification, "the compressibility of the conductor portion" is defined by the ratio of the cross-sectional area of the conductor portion after the press-crimping to the cross-sectional area of the conductor portion before the press-clamping".

However, stresses acting on the conductor portion increases with the increase of the compressibility of the conductor portion. And besides, aluminum is inferior in mechanical strength to copper. Therefore, when an excessive stress acts on the conductor portion of the aluminum wire, a press-clamping strength of the terminal is greatly lowered. Therefore, there has been proposed an aluminum wire press-clamping terminal of the type in which a contact resistance between the reduction of a contact resistance between a conductor portion and the terminal and the securing of a press-clamping strength of the terminal are both achieved (see, for example, JP-A-2007-173215).

As shown in FIG. 5, the press-clamping terminal disclosed in JP-A-2007-173215 has a plurality of grooves 106 formed in inner surfaces (contact surfaces) of a bottom plate portion 104 and caulking piece portions 105 which are adapted to contact a conductor portion 102. A depth of these grooves is determined according to a diameter of each of strands forming the conductor portion 102 of an aluminum wire 101. When the caulking piece portions 105 are caulked onto the conductor portion 102 of the aluminum wire 101, the strands 103 of the conductor portion 102 intrude into the grooves 106, so that oxide films formed on the surfaces of the strands 103 are destroyed, and besides the withdrawal of the conductor portion 102 is prevented. By doing so, a contact resistance between the conductor portion 102 and the terminal is reduced, and also a press-clamping strength of the terminal is secured.

At the time when the caulking piece portions of the terminal are caulked to the conductor portion placed on the bottom plate portion, a load acts also on the bottom plate portion and the caulking piece portions. The terminal is made of a highly-ductile sheet material such as a copper alloy sheet as described above, and the bottom plate portion and the caulking piece portions, when receiving a load, are extended in an axial direction of the conductor portion. In the aluminum wire press-clamping terminal disclosed in JP-A-2007-173215, the bottom plate portion 104 as well as the caulking piece portions 105 are uniform in thickness in the axial direction of the conductor portion 102, and the bottom plate portion 104 and the caulking piece portions 105, when receiving a load, are extended in the axial direction of the conductor portion 102, and are reduced in thickness. Particularly, a central portion (in the axial direction) of the bottom plate portion 104 and a central portion (in the axial direction) of each caulking piece portion 105 are extremely reduced in thickness. Therefore, it is feared that the strength of the terminal may be lowered, so that the press-clamping strength of the terminal may be lowered.

SUMMARY OF THE INVENTION

This invention has been made in view of the above circumstances, and an object of the invention is to provide a press-clamping terminal for an aluminum wire in which the reduction of a contact resistance between a conductor portion of the aluminum wire and the terminal, and the securing of the press-clamping strength of the terminal can be both achieved easily and positively.

The above object has been achieved by an aluminum wire press-clamping terminal recited in the following configurations (1) to (4).

(1) An aluminum wire press-clamping terminal for being press-clamped to an aluminum wire having a conductor portion in which a plurality of aluminum- or aluminum alloy-made strands are twisted, the aluminum wire press-clamping terminal including: a bottom plate portion for placing the conductor portion thereon; a pair of caulking piece portions which are extended from the bottom plate portion and adapted to be caulked to the conductor portion on the bottom plate portion to hold the conductor portion therebetween; and at least one groove and at least one convex portion which are formed on contact surfaces of the bottom plate portion and the pair of caulking piece portions, the contact surfaces being adapted to contact the conductor portion, wherein the convex portion extends in a direction perpendicular to an axial direction of the conductor portion.

(2) The aluminum wire press-clamping terminal according to (1), wherein the convex portion is formed at a central portion of the contact surfaces, the central portion being central in the axial direction of the conductor portion.

(3) The aluminum wire press-clamping terminal according to (1), wherein the convex portion is formed between a plurality of the grooves.

(4) The aluminum wire press-clamping terminal according to (1), wherein the groove extends in the direction perpendicular to the axial direction of the conductor portion to be made parallel to the convex portion.

In the aluminum wire press-clamping terminal of the above configurations, the groove is formed in the inner surfaces (contact surfaces) of the bottom plate portion and the pair of caulking piece portions (of the terminal) which are adapted to contact the conductor portion of the aluminum wire. When the caulking piece portions are caulked to the conductor portion of the aluminum wire, the strands of the conductor portion intrude into the groove, so that oxide films formed on the surfaces of the strands are destroyed, and besides the withdrawal of the conductor portion is prevented. As a result, a contact resistance between the conductor portion and the terminal is reduced, and a sufficient press-clamping strength of the terminal can be secured. Further, the convex portion is formed on the bottom plate portion and the pair of caulking piece portions of the terminal, and extends in the direction perpendicular to the axial direction of the conductor portion. At the time when the caulking piece portions are caulked to the conductor portion of the aluminum wire, a load acts also on the bottom plate portion and the caulking piece portions, and this load serves to crush the convex portion. The load acting on the bottom plate portion and the caulking piece portions is absorbed as a result of crushing of the convex portion. Therefore, the thickness of the bottom plate portion and the thickness of each caulking piece portion can be maintained, and the strength of the terminal is prevented from being reduced, and the sufficient press-clamping strength of the terminal can be secured. Furthermore, when the convex portion is crushed, a friction develops between the convex portion and the strands of the conductor portion, so that the oxide films formed on the surfaces of the strands are destroyed. As a result, the contact resistance between the conductor portion and the terminal can be reduced.

Preferably, the convex portion is formed at the central portions of the inner surfaces (contact surfaces) of the bottom plate portion and each caulking piece portion which would be much reduced in thickness when extended in the axial direction.

In the aluminum wire press-clamping terminal of the present invention, the reduction of the contact resistance between the conductor portion of the aluminum wire and the terminal, and the securing of the press-clamping strength of the terminal can be both achieved easily and positively.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

A preferred embodiment of a press-clamping terminal of the present invention for an aluminum wire will now be described in detail with reference to the drawings.

Figure 1:
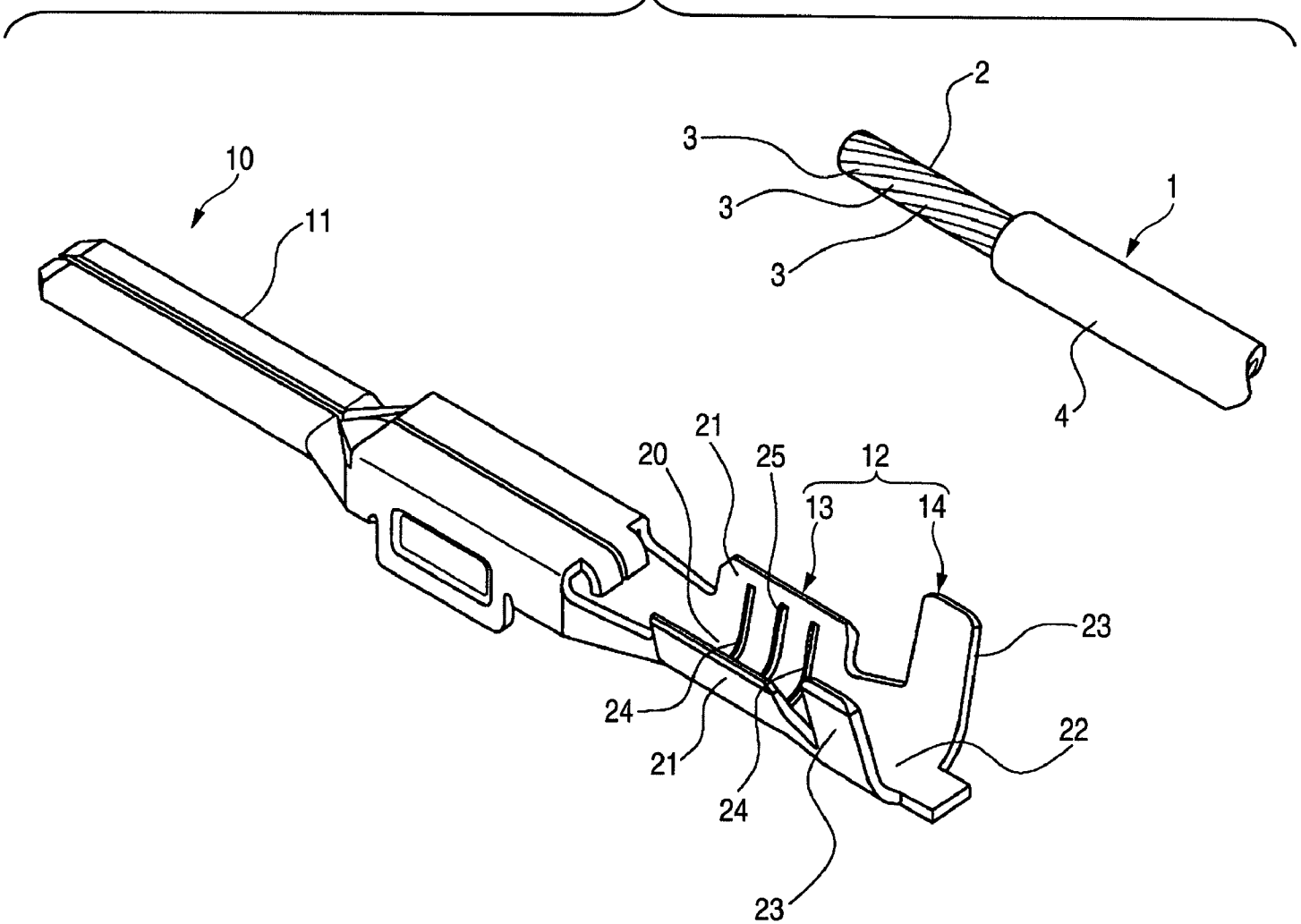
FIG. 1 is a perspective view of one preferred embodiment of an aluminum wire press-clamping terminal of the present invention.
Figure 2:
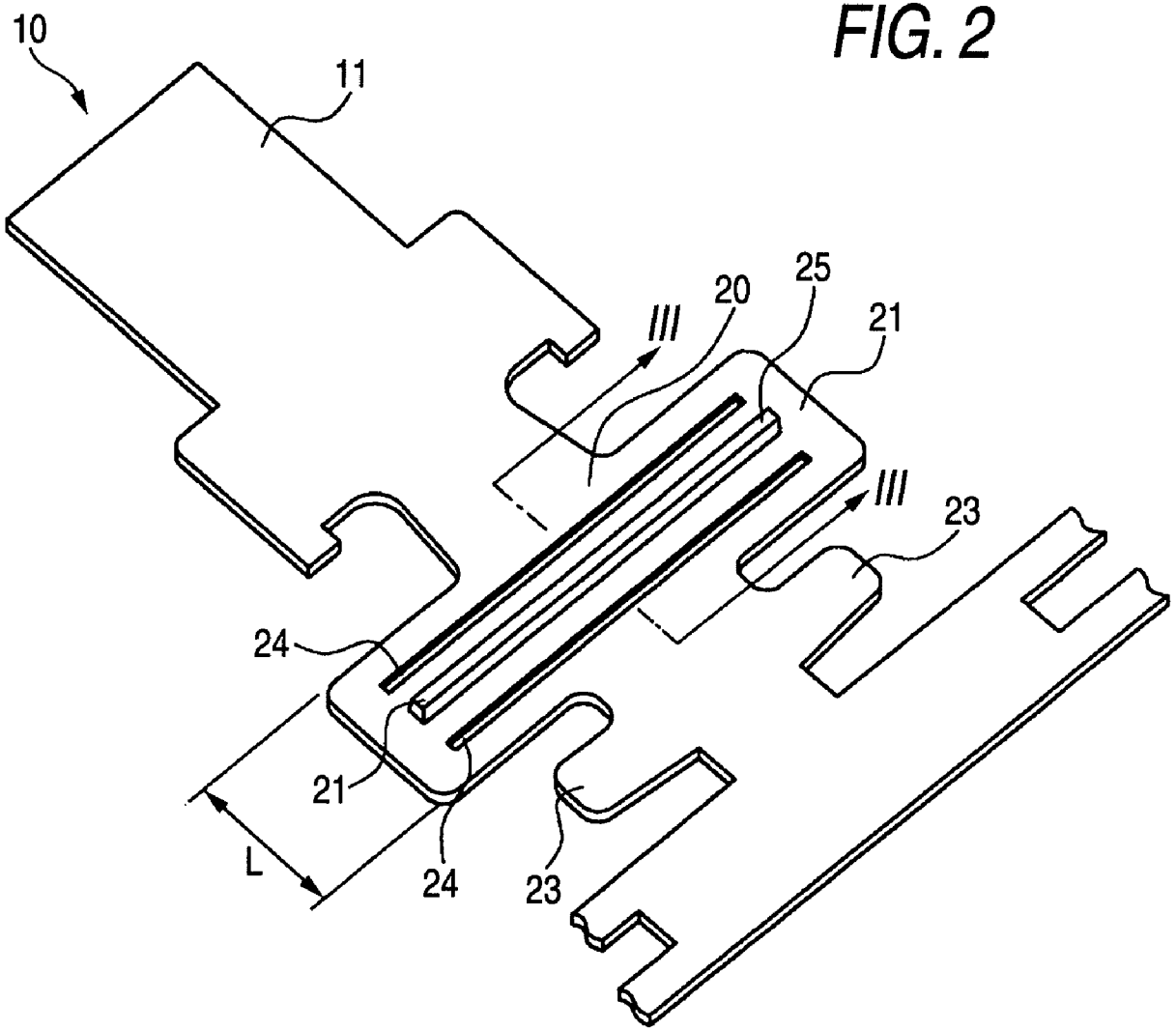
FIG. 2 is a developed view of the terminal of FIG. 1.
Figure 3:
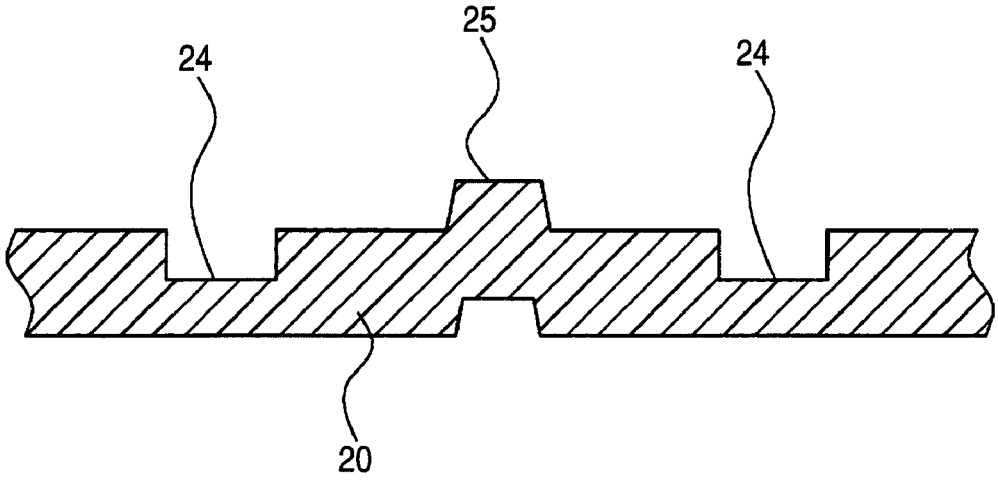
FIG. 3 is a cross-sectional view taken along the line III-III of FIG. 2.
Figure 4:
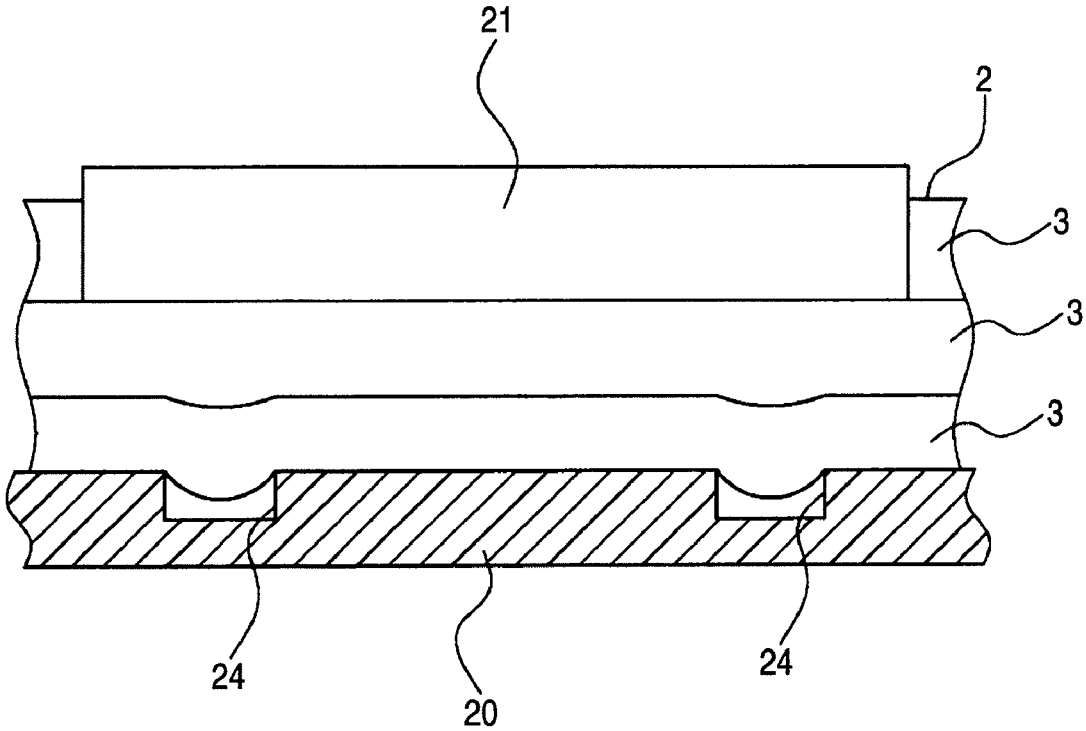
FIG. 4 is a cross-sectional view similar to FIG. 3, but showing a condition in which the terminal of FIG. 1 is press-clamped to an aluminum wire.
Figure 5:
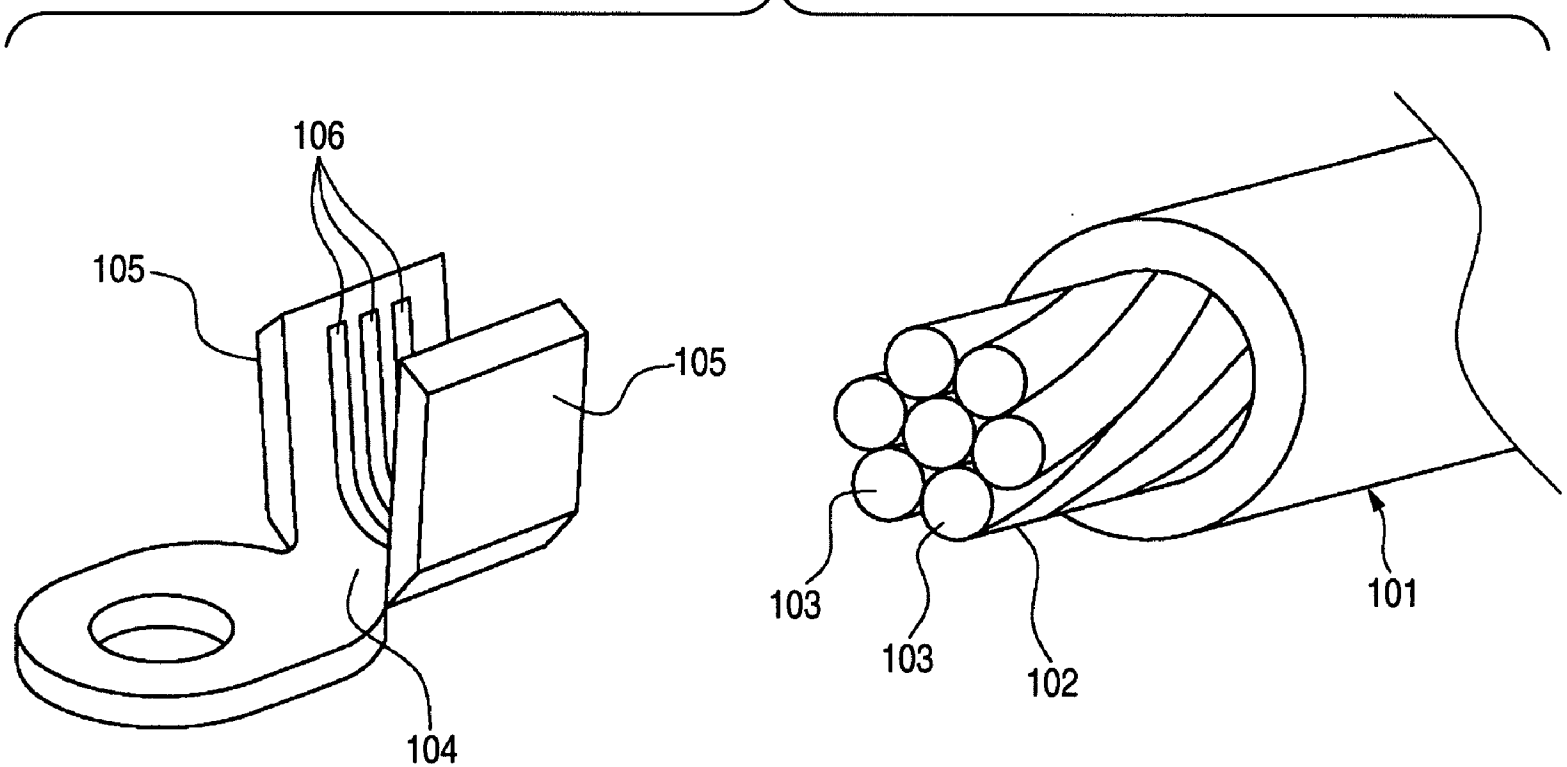
FIG. 5 is a perspective view showing a known press-clamping terminal for an aluminum wire.

FIG. 1 is a perspective view of one preferred embodiment of the aluminum wire press-clamping terminal of the invention, FIG. 2 is a developed view of the terminal of FIG. 1, FIG. 3 is a cross-sectional view taken along the line III-III of FIG. 2, and FIG. 4 is a cross-sectional view similar to FIG. 3, but showing a condition in which the terminal is press-clamped to an aluminum wire.

As shown in FIG. 1, the aluminum wire 1 includes a conductor portion 2 composed of a plurality of aluminum- or aluminum alloy-made strands 3 twisted together, and a sheath 4 made of an insulating material and covering an outer periphery of the conductor portion 2. The sheath 4 is removed over a predetermined length from one end portion of the aluminum wire 1, so that the conductor portion 2 is exposed at the one end portion of the aluminum wire 1. The press-clamping terminal 10 to be press-clamped to this aluminum wire 1 is press-clamped to this end portion of the aluminum wire 1. One preferred example of aluminum alloy is an alloy of aluminum and iron. A conductor made of this alloy is more ductile and has a higher strength (particularly a tensile strength) than a conductor made of aluminum.

The terminal 10 has a connection portion 11 (for connection to a mating terminal (not shown)) formed at its distal end portion, and also has a holding portion 12 (for holding the aluminum wire 1) formed at its proximal end portion. The holding portion 12 includes a conductor holding portion 13 (for holding the conductor portion 2 of the aluminum wire 1) formed at its distal end portion, and a sheath holding portion 14 (for holding the sheath 4 of the aluminum wire 1) formed at its proximal end portion.

The conductor holding portion 13 includes a bottom plate portion 20 for placing the conductor portion 2 (exposed at the end portion of the aluminum wire 1) thereon, and a pair of conductor caulking piece portions 21 formed on and extending from the bottom plate portion 20 so as to hold the conductor portion 2 therebetween. The conductor holding portion 13 is formed or shaped into a generally U-shaped cross-section in a plane perpendicular to the axis of the conductor portion 2 placed on the bottom plate portion 20.

The sheath holding portion 14 includes a bottom plate portion 22 for the placing of the sheath 4 (at the end portion of the aluminum wire 1) thereon, and a pair of sheath caulking piece portions 23 formed on and extending from the bottom plate portion 22 so as to hold the sheath 4 therebetween. Like the conductor holding portion 13, the sheath holding portion 14 is formed into a generally U-shaped cross-section. The bottom plate portion 22 of the sheath holding portion 14 extends from the proximal end of the bottom plate portion 20 of the conductor holding portion 13.

As best shown in FIGS. 2 and 3, two parallel grooves 24 are formed in an inner surface (contact surface) of the bottom plate portion 20 and inner surfaces (contact surfaces) of the pair of conductor caulking piece portions 21 (which are adapted to contact the conductor portion 2), and extend in a direction perpendicular to the axial direction of the conductor portion 2. The number of the grooves 24 is not limited to two, and may be three or more. The grooves 24 do not need to be limited to the type extending perpendicular to the axial direction, and may be of the type extending parallel to the axial direction.

A convex portion (or ridge) 25 is formed on the inner surface of the bottom plate portion 20 and the inner surfaces of the pair of conductor caulking piece portions 21, and extends in a direction perpendicular to the axial direction of the conductor portion 2. This convex portion 25 is disposed between the two grooves 24, and lies substantially at a central portion (in the axial direction of the conductor portion 2) of the inner surface (contact surface) of the bottom plate portion 20 and also substantially at a central portion (in the axial direction of the conductor portion 2) of the inner surface (contact surface) of each of the two conductor caulking piece portions 21 (that is, lies substantially centrally of an axial length L of each of the bottom plate portion 20 and each conductor caulking piece portion 21). In this embodiment, the convex portion 25 is made parallel to the two grooves 24 in the direction perpendicular to the axial direction of the conductor portion 2. Two or more convex portions 25 may be formed, and for example there may be provided an arrangement in which three convex portions 25 are formed, and are spaced from one another in the axial direction, and the groove 24 is disposed between any two adjacent convex portions 25. Even in the case where a plurality of convex portions 25 are formed, at least one convex portion 25 is preferably disposed substantially at the central portion (in the axial direction of the conductor portion 2) of the inner surface (contact surface) of the bottom plate portion 20 and also substantially at the central portion (in the axial direction of the conductor portion 2) of the inner surface (contact surface) of each of the two conductor caulking piece portions 21.

The terminal 10 of the above construction is formed by blanking a piece of a predetermined shape from an electrically-conductive sheet (made, for example, of a copper alloy) into a predetermined shape and then by bending the blanked-out piece into the final shape.

The pair of conductor caulking piece portions 21 of the conductor holding portion 13 are caulked onto the conductor portion 2 of the aluminum wire 1 placed on the bottom plate portion 20 of this conductor holding portion 13, and also the pair of sheath caulking piece portions 23 of the sheath holding portion 14 are caulked onto the sheath 4 of the aluminum wire 1 placed on the bottom plate 22 of this sheath holding portion 14. In this manner, the terminal 10 is press-clamped to the aluminum wire 1.

When the conductor caulking piece portions 21 of the terminal 10 are caulked to the conductor portion 2 of the aluminum wire 1 as shown in FIG. 4, the strands 3 of the conductor portion 2 intrude into the grooves 24 formed in the inner surfaces of the bottom plate portion 20 and conductor caulking piece portions 21. As a result, oxide films formed on the strands 3 are destroyed, and besides the conductor portion 2 is prevented from being withdrawn from the conductor holding portion 13.

At the time when the conductor caulking piece portions 21 of the terminal 10 are caulked to the conductor portion 2 of the aluminum wire 1, a load acts also on the bottom plate portion 20 and the conductor caulking piece portions 21. This load serves to crush the convex portion 25 formed on the inner surfaces of the bottom plate portion 20 and conductor caulking piece portions 21. Then, the load acting on the bottom plate portion 20 and the conductor caulking piece portions 21 is absorbed as a result of crushing of the convex portion 25, and therefore the thickness of the bottom plate portion 20 as well as the thickness of each of the two conductor caulking piece portions 21 is maintained.

In the process of crushing of the convex portion 25 formed on the inner surfaces of the bottom plate portion 20 and conductor caulking piece portions 21, a friction develops between the strands 3 of the conductor portion 2 and the convex portion 25, so that the oxide films formed on the strands 3 are destroyed, and the bare surfaces of the strands 3 made of aluminum or aluminum alloy are exposed. As a result, a good conductive connection between the conductor portion 2 and the terminal 10 is secured.

In the aluminum wire press-clamping terminal 10 of this embodiment, when the conductor caulking piece portions 21 are caulked to the conductor portion 2 of the aluminum wire 1, the strands 3 of the conductor portion 2 intrude into the grooves 24, so that the oxide films formed on the strands 3 are destroyed, and besides the withdrawal of the conductor portion 2 is prevented. As a result, a contact resistance between the conductor portion 2 and the terminal 10 can be reduced, and besides the press-clamping strength of the terminal 10 can be secured.

Furthermore, in the aluminum wire press-clamping terminal 10 of this embodiment, at the time when the conductor caulking piece portions 21 are caulked to the conductor portion 2 of the aluminum wire 1, a load acts also on the bottom plate portion 20 and the conductor caulking piece portions 21, and this load serves to crush the convex portion 25, and is absorbed as a result of crushing of the convex portion 25. Therefore, the thickness of the bottom plate portion 20 as well as the thickness of each of the two conductor caulking piece portions 21 is maintained, and the strength of the terminal 10 is prevented from being reduced, so that the press-clamping strength of the terminal 10 can be secured.

In the aluminum wire press-clamping terminal 10 of this embodiment, a friction develops between the convex portion 25 and the strands 3 of the conductor portion 2 when the convex portion 25 is crushed, and the oxide films formed on the surfaces of the strands 3 are destroyed. As a result, the contact resistance between the conductor portion 2 and the terminal 10 can be reduced.

Furthermore, in the aluminum wire press-clamping terminal 10 of this embodiment, the convex portion 25 is formed at the central portions of the inner surfaces (contact surfaces) of the bottom plate portion 20 and each caulking piece portion 21 which would be much reduced in thickness when extended in the axial direction, and therefore the thickness of the bottom plate portion 20 and the thickness of each conductor caulking piece portion 21 can be positively maintained. Therefore, the strength of the terminal 10 is prevented from being reduced, so that the press-clamping strength of the terminal 10 can be secured.

The present invention is not limited to the above embodiment, and suitable modifications, improvements, etc., can be made. Furthermore, the shape, dimensions, numerical values, form, disposition, etc., of each of the constituent elements of the above embodiment can be arbitrary and are not limited in so far as the invention can be achieved.

What is claimed is:

1. An aluminum wire press-clamping terminal for being press-clamped to an aluminum wire having a conductor portion in which a plurality of aluminum- or aluminum alloy-made strands are twisted, the aluminum wire press-clamping terminal comprising:

a bottom plate portion for placing the conductor portion thereon;

a pair of caulking piece portions which are extended from the bottom plate portion and adapted to be caulked to the conductor portion on the bottom plate portion to hold the conductor portion between the pair of caulking piece portions and the bottom plate portion; and at least one groove and at least one convex portion which are formed substantially in parallel to each other on contact surfaces of the bottom plate portion and the pair of caulking piece portions, the contact surfaces being adapted to contact the conductor portion, wherein the at least one groove is recessed from the contact surfaces and the at least one convex portion protrudes from the contact surfaces, wherein the contact surfaces exist between an edge of the at least one groove and a foot of the at least one convex portion, and an outer edge of the at least one groove forms a right angle, and wherein the convex portion extends in a direction perpendicular to an axial direction of the conductor portion.

2. The aluminum wire press-clamping terminal according to claim 1, wherein the convex portion is formed at a central portion of the contact surfaces, the central portion being central in the axial direction of the conductor portion.

3. The aluminum wire press-clamping terminal according to claim 1, wherein the convex portion is formed between a plurality of the grooves.

4. The aluminum wire press-clamping terminal according to claim 1, wherein the groove extends in the direction perpendicular to the axial direction of the conductor portion to be made parallel to the convex portion.

5. The aluminum wire press-clamping terminal according to claim 1, wherein the at least one convex portion and the at least one groove are formed at the contact surfaces prior to caulking the pair of caulking piece portions to the conductor portion.

6. The aluminum wire press-clamping terminal according to claim 1, wherein the aluminum wire has an insulated portion in which the aluminum wire is covered by an insulating sheath and a conductor portion in which the aluminum wire is not covered by the insulating sheath, the terminal further comprising:

another bottom plate portion for placing the insulated portion thereon;

another pair of caulking piece portions which are extended from the other bottom plate portion and adapted to be caulked to the insulated portion to hold the insulated portion between the other pair of caulking piece portions and the other bottom plate portion.

7. The aluminum wire press-clamping terminal according to claim 1, wherein the outer edge of the at least one groove that is formed as a right angle is sharp.

* * * * *